United States Patent [19]

Tashiro et al.

[11] 4,233,540

[45] Nov. 11, 1980

[54] MAGNETRON FOR MICROWAVE OVEN

[75] Inventors: Norio Tashiro, Yokohama; Hirokazu Takahashi, Tokyo, both of Japan

[73] Assignee: Tokyo Shibaura Denki Kabushiki Kaisha, Kawasaki, Japan

[21] Appl. No.: 3,426

[22] Filed: Jan. 9, 1979

[30] Foreign Application Priority Data

Jan. 18, 1978 [JP] Japan ..... 53/3797

[51] Int. Cl.[3] ..... H01J 25/50

[52] U.S. Cl. ..... 315/39.51; 313/341; 313/344; 315/39.75

[58] Field of Search ..... 313/337, 441, 444, 341, 313/344; 315/39.51, 39.75, 39.77

[56] References Cited

U.S. PATENT DOCUMENTS

| | | | |
|---|---|---|---|
| 3,558,970 | 1/1971 | Van De Goor et al. | 315/39.51 |
| 3,944,872 | 3/1976 | Wilbur et al. | 315/39.51 |
| 4,066,928 | 1/1978 | Van Besouw et al. | 315/39.77 |
| 4,143,295 | 3/1979 | Oguro | 313/337 |

*Primary Examiner*—Saxfield Chatmon, Jr.

*Attorney, Agent, or Firm*—Cushman, Darby & Cushman

[57] ABSTRACT

A magnetron for microwave ovens, wherein the thickness d of a coiled filament constituting a cathode in the axial direction of the cathode bears a ratio d/p of 0.3 or less to the pitch p of turns of the coiled filament in the axial direction of the cathode.

6 Claims, 12 Drawing Figures

MAGNETRON FOR MICROWAVE OVEN

This invention relates to a continuous wave magnetron, and more particularly to a magnetron for microwave ovens, which is provided with an improved filament cathode in the form of a coil.

A continuous wave magnetron for microwave ovens includes a hollow cylindrical anode having a plurality of vanes and a coiled cathode arranged coaxially with the hollow cylindrical anode. The coiled cathode, which is made of thorium-tungsten and whose surface is carburized, is directly heated. The cathode is therefore quickly responsive, and suitable for microwave ovens. It starts to emit electrons in a few seconds after the anode power and the cathode power have been turned on at the same time. In the microwave ovens in common use, the anode power supply is not perfect DC voltage, and the anode current is therefore pulsating current.

In order to prevent noise leak from the cathode stem of such a magnetron as described above, the input section of the magnetron is provided with a filter circuit surrounded by a shield case. The filter circuit, however, could not suppress line noise in the relatively low frequency band, (for ex. 0.5~1.5 MHz). The line noise varies according to the load on the magnetron or the input power of the magnetron. For example, it has such a frequency distribution as illustrated in FIG. 1.

This invention is based on the inventors finding that such line noise generated in relatively low frequency band is closely related to an oscillatory phenomenon which is observed in the waveform of the anode current. The oscillatory phenomenon displayed by an oscilloscope is shown in FIG. 2. As shown in FIG. 2, this phenomenon takes place at a specific anode current level. In addition, the level or the spectrum of line noise is largely affected by the load impedance on the magnetron. The spectrum in this case has a peak between 0.5 MHz and 1.5 MHz. Plotting these maximum noise levels between 0.5 MHz and 1.5 MHz on a Smith chart, we get the distribution of the maximum noise levels as illustrated in FIG. 3. From FIG. 3 it is noted that the noise level is low at the sink region and is high at the anti-sink region. The analysis of the oscillatory phenomenon suggests that such line noise as shown in FIG. 1 would be generated in the following manner.

As the microwave field in the interaction space is strong at high VSWR anti-sink region, the backbombardment of electrons on the cathode is strong at this region. The cathode temperature is therefore raised and the thermal emission increases. At the same time, the secondary emission also increases. As a result, the electron cloud density in the vicinity of the cathode increases, and a virtual cathode is formed near the cathode surface. When the anode current increases under this condition and reaches a specific value, the electron cloud in the vicinity of the cathode becomes unstable to induce an oscillatory phenomenon in the anode current. This phenomenon results in high level line noise.

An object of this invention is to suppress noise generation in a magnetron for microwave ovens.

Another object of the invention is to provide a magnetron in which the thickness of the filament constituting the coiled cathode in the axial direction of the cathode and the pitch of the turns of the coiled cathode in the axial direction thereof are so proportionated as to reduce line noise.

According to this invention, the ratio d/p of the thickness d of the filament to the pitch p of the turns of the coiled cathode is 0.3 or less.

Preferably, the thickness d of the filament is 0.4 mm to 0.8 mm.

This invention can be more fully understood from the following detailed description when taken in conjunction with the accompanying drawings, in which.

Figure 7:
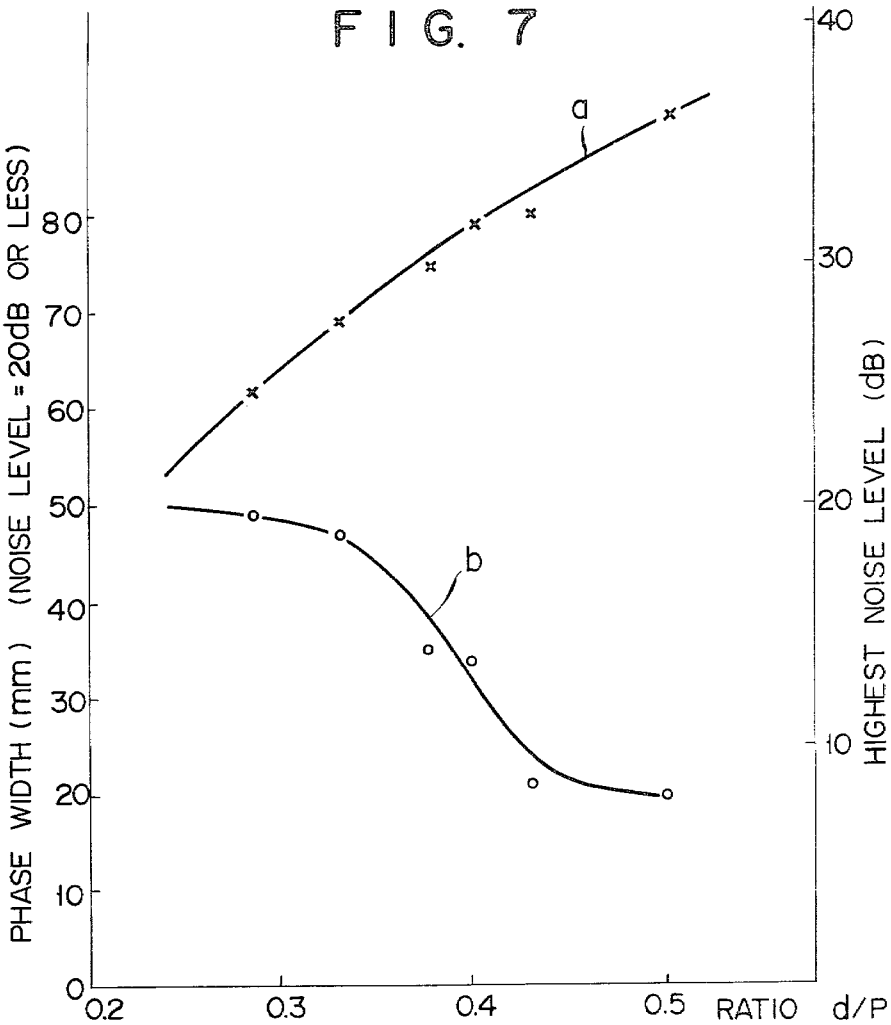

FIGS. 6A to 6F show each relationship between the level of line noise and the phase of standing wave, and the relationship corresponding to the specific ratio d/p between the thickness d of a filament constituting a coiled cathode in the axial direction of the cathode and the pitch p of the turns of the coiled cathode in the axial direction thereof; and FIG. 7 is a graph in which a curve a represents the relationship between said ratio d/p and the highest noise level and a curve b represents the relationship between said ratio d/p and the phase width where the noise level is 20 dB or less.

Figure 4:
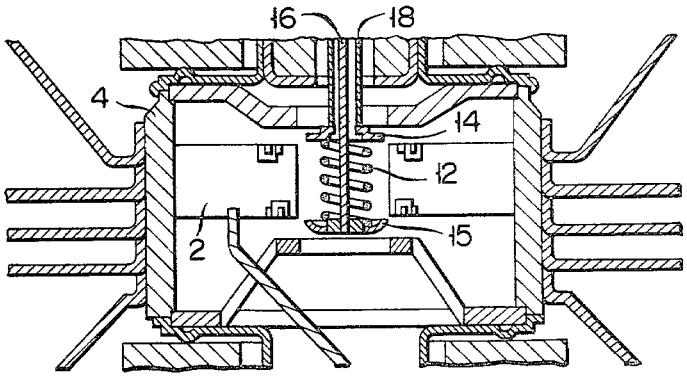
FIG. 4 is a vertical cross sectional view of the main part of a magnetron for microwave ovens according to this invention.
Figure 6A:
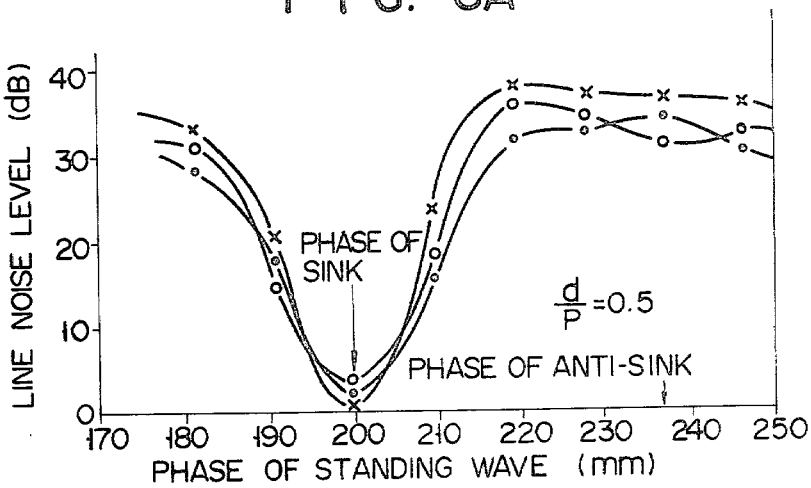
Figure 6B:
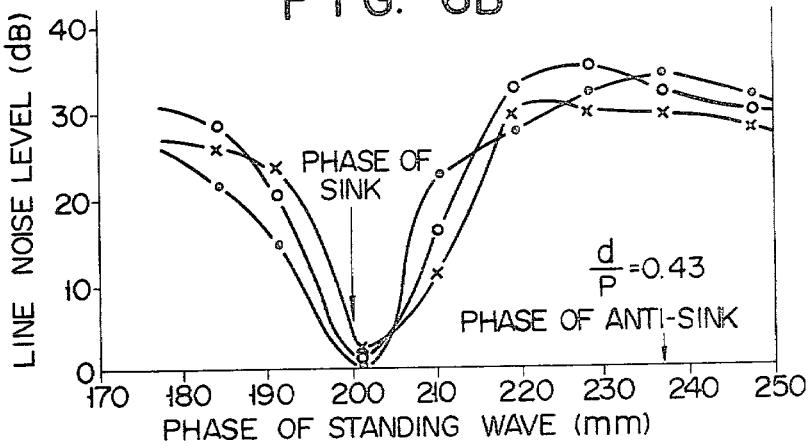
Figure 6C:
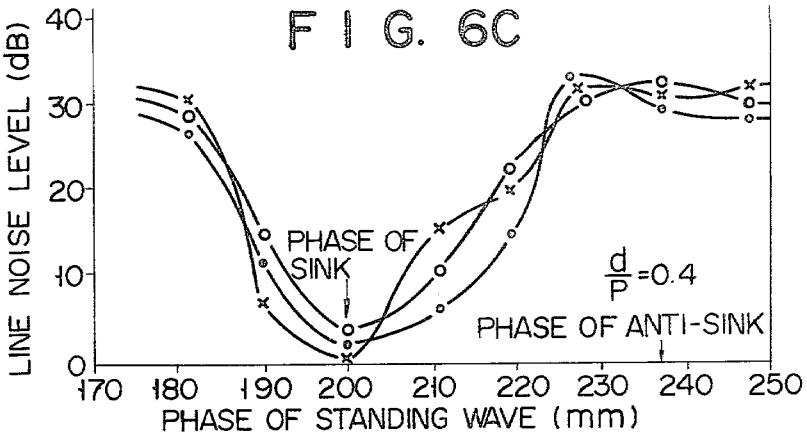
Figure 6D:
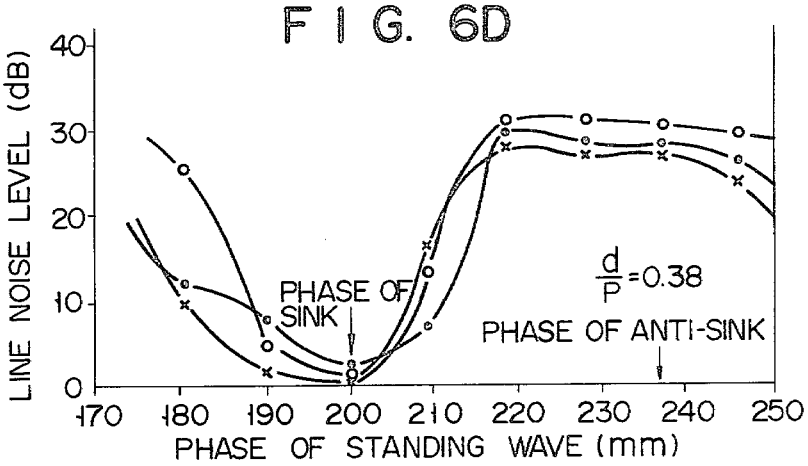
Figure 6E:
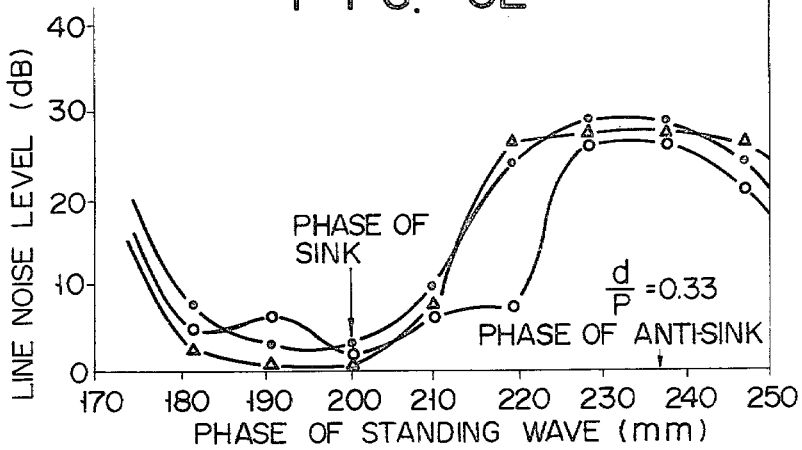
Figure 6F:
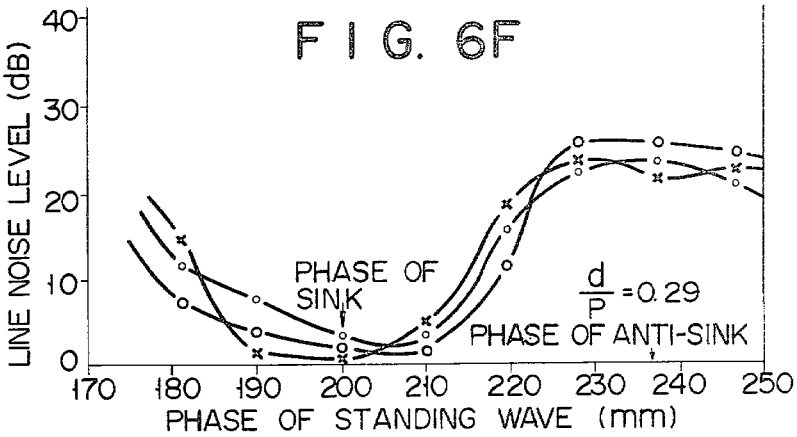

As shown in FIG. 4, a magnetron for microwave ovens according to this invention comprises an anode constituted by a plurality of anode vanes 2 and a hollow anode cylinder 4 and a cathode disposed coaxially with the anode and constituted by a coiled filament 12, cup-shaped end hats 14 and 15 holding the ends of the filament 12, respectively, a support rod 16 supporting the end hat 15 and a hollow cylinder 18 supporting the end hat 14. The filament 12, which acts as a directly heated cathode, is made of, preferably, a thorium-tungsten wire with a carburized surface. In the space between the filament 12 and the free end of the anode vanes 2, electrons will fly back and forth.

Figure 2:
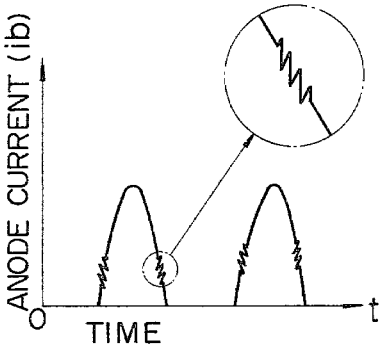
FIG. 2 shows the waveform of the anode current of a conventional magnetron.
Figure 1:
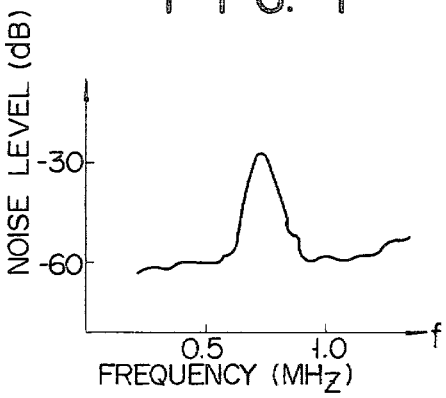
FIG. 1 shows the frequency spectrum distribution of line noise generated by a conventional magnetron.
Figure 3:
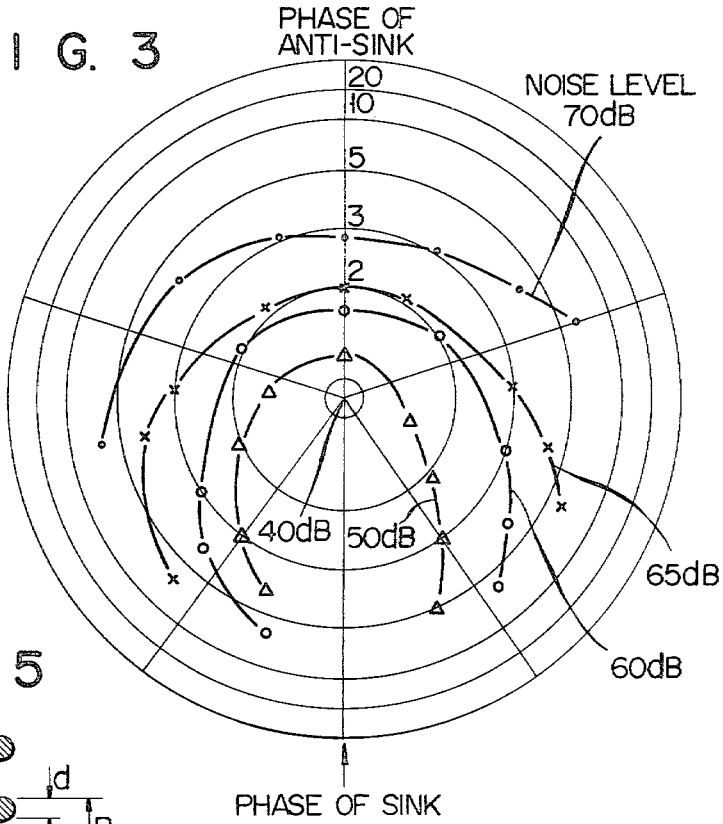
FIG. 3 is a Smith chart prepared by plotting the levels of noise generated by a conventional magnetron.
Figure 5:
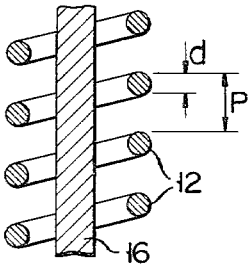
FIG. 5 is a vertical cross sectional view of a portion of a coiled cathode according to this invention.

As illustrated in FIG. 5, the thickness d of the coiled filament 12 in the axial direction of the cathode is proportionated with the pitch p of the turns of the filament 12 in the axial direction of the cathode. More specifically, the ratio of the thickness d to the pitch p is 0.3 or less. The "thickness d" and "pitch p" are the average values of one coiled filament 12. The surface portions of the turns of the filament 12, which face the free ends of the vanes 2, are electron-emitting surfaces.

Magnetrons of six types A to F were made, which differed in the above-mentioned thickness d and pitch p as tabulated in the following Table 1. Three magnetrons of each type were tested under various load impedances which were set by shifting a standing wave generator at VSWR=2. The results are shown in FIGS. 6A to 6F. The magnetrons were operated at fundamental oscillation frequency of 2450 MHz, and the noise level was measured searching the highest level in the frequency band from 0.5 to 1.5 MHz. Table 1 also shows the phase width at which the noise level is 20 dB or less when the reflection phase is changed by shifting the standing wave generator at VSWR=2.

TABLE 1

| Magnetron type | A | B | C | D | E | F |
|---|---|---|---|---|---|---|
| Thickness d (mm) | 0.6 | 0.6 | 0.4 | 0.6 | 0.6 | 0.6 |
| Pitch p (mm) | 1.2 | 1.4 | 1.0 | 1.6 | 1.8 | 2.1 |
| d/p Ratio | 0.5 | 0.43 | 0.4 | 0.38 | 0.33 | 0.29 |
| Phase width of | 20 | 22 | 31 | 28 | 44 | 47 |
| noise level, 20dB | 19 | 18 | 35 | 39 | 50 | 54 |
| or less (mm) | 21 | 24 | 35 | 36 | 45 | 54 |
| Mean phase width | 20.0 | 21.3 | 33.7 | 34.3 | 46.3 | 48.7 |

Type A corresponds to the conventional magnetrons. In the above-mentioned experiment, VSWR was chosen to be 2.

This is because in the microwave ovens in common use, the load impedance VSWR at phase of anti-sink region where noise level is high, rarely exceeds 2.

The results of the experiment are compiled in FIG. 7. FIG. 7 clearly shows that as d/p ratio is reduced from 0.5, the phase width at which the noise level is 20 dB or less will abruptly increase, while the highest noise level is lowered. This means that the noise is reduced more and more as d/p ratio is reduced. When d/p ratio is reduced to a little less than 0.3, the phase width at which the noise level is 20 dB or less increases but slowly. If d/p ratio becomes far less than 0.3, however, the magnetron does not operate stably because the cathode emits less electrons than necessary.

The thickness d of the filament 12 is in most cases substantially equal to the diameter of the filament 12. If the diameter (or the thickness d) of the filament 12 is too small, the carburized thorium-tungsten filament 12 becomes mechanically too weak to be used practically. If the diameter of the filament 12 is too large, the pitch p will become large to provide a suitable d/p ratio. As a result, it becomes difficult to make an outer surface of the coiled filament wire cylindrical. An experiment showed that the thickness d of the filament in the axial direction of the cathode should preferably be 0.4 mm to 0.8 mm.

This invention makes it possible to reduce line noise of about 0.5 to 1.5 MHz to very low level. This noise reduction is possible in a considerably large area around sink phase. Even outside this particular area the noise level can be lowered sufficiently. This noise reduction is possible perhaps, because in the magnetron of the above-described structure, no excessive electrons stay in the vicinity of the cathode and no oscillatory phenomenon chances to take place in the anode current.

Usually the load impedance of microwave ovens is located in the vicinity of the sink region so as to make the magnetrons of the ovens operate with high efficiency. In view of this, the magnetron according to this invention is very effective in reducing the noise generated in the microwave ovens.

What we claim is:

1. A magnetron for a microwave oven comprising a hollow cylindrical anode having a plurality of strapped anode vanes and a cathode including a coiled filament disposed coaxially with the hollow cylindrical anode, the ratio of the thickness d of said filament in the axial direction of the cathode to the pitch p of turns of the coiled filament in the axial direction of the cathode being 0.3 or less, said magnetron suppressing noise generation in the frequency range of approximately 0.5 to 1.5 Mhz.

2. A magnetron according to claim 1, wherein the thickness d of said filament is 0.4 mm to 0.8 mm.

3. A magnetron according to claim 1, wherein the ratio of the thickness d to the pitch p is large so that said cathode emits sufficient electrons.

4. A magnetron according to claim 1 wherein said pitch is less than half of the outer diameter of said cathode.

5. A magnetron according to claim 1 wherein said cathode and anode are substantially symmetrical to each other to create a substantially electric field between the cathode and anode.

6. A magnetron according to claim 1 wherein the outer surface of said coiled filament is substantially cylindrical.

* * * * *